US005592169A

United States Patent [19]

Nakamura et al.

[11] Patent Number: 5,592,169

[45] Date of Patent: Jan. 7, 1997

[54] TRANSMITTER FOR VEHICLE REMOTE CONTROL SYSTEM

[75] Inventors: Yasunori Nakamura, Yamanashi-ken; Shunji Kato, Saitama-ken, both of Japan

[73] Assignee: Mitsui Kinzoku Kogyo Kabushiki Kaisha, Tokyo, Japan

[21] Appl. No.: 360,353

[22] Filed: Dec. 21, 1994

[30] Foreign Application Priority Data

Dec. 24, 1993 [JP] Japan ..... 5-348187
Dec. 29, 1993 [JP] Japan ..... 5-352275

[51] Int. Cl.[6] ..... G08C 19/12

[52] U.S. Cl. ..... 341/173; 340/693; 340/825.69

[58] Field of Search ..... 341/176, 173; 340/693, 426, 825.69, 825.72; 323/906

[56] References Cited

U.S. PATENT DOCUMENTS

| | | | |
|---|---|---|---|
| 4,357,602 | 11/1982 | Lemelson | 340/539 |
| 4,496,942 | 1/1985 | Matsuoka | 341/176 |
| 4,893,240 | 1/1990 | Karkouti | 341/176 |
| 5,008,661 | 4/1991 | Raj | 340/825.69 |
| 5,111,199 | 5/1992 | Tomoda et al. | 341/176 |
| 5,220,319 | 6/1993 | Kendel | 341/176 |
| 5,252,966 | 10/1993 | Lambropoulos et al. | 341/176 |
| 5,331,325 | 7/1994 | Miller | 341/176 |
| 5,457,447 | 10/1995 | Ghaem et al. | 323/906 |

FOREIGN PATENT DOCUMENTS 64-52967 3/1989 Japan .

*Primary Examiner*—Jeffery Hofsass
*Assistant Examiner*—Timothy Edwards, Jr.
*Attorney, Agent, or Firm*—Browdy and Neimark

[57] ABSTRACT

A remote control transmitter used for a switching of a state of a door lock device between a locked state and an unlocked state and so on comprises a portable-size case, operating buttons provided on an outer surface of the case, a secondary battery provided within the case, a solar battery provided on the outer surface of the case and rechargeably connected to the secondary battery, and a generator for generating a coded signal. One terminal of each operating button is connected to a positive terminal of the secondary battery and the other terminal is connected to a positive terminal of the generator. When one of the operating buttons is pushed, electric current is fed from the secondary battery to the generator.

15 Claims, 3 Drawing Sheets

TRANSMITTER FOR VEHICLE REMOTE CONTROL SYSTEM

FIELD OF THE INVENTION

This invention generally relates to a transmitter for a vehicle remote control system and more particularly to a transmitter which is used for controlling, for example, operations of switching the state of a door lock device between a locked state and an unlocked state, of releasing of a trunk lid, of opening and closing window glass, of starting and stopping an engine and of turning on and off a hazard lamp or flasher.

DESCRIPTION OF THE PRIOR ART

The Japanese Patent Application Laid-Open No. 64-52967 describes a conventional portable transmitter to be used for switching the state of a vehicle door lock device between a locked state and an unlocked state. The conventional transmitter has a key portion, a case for covering a base part of the key portion, an operating button provided on the outer surface of the case, a rechargeable secondary battery provided in the case, a coded signal generator and a pair of charging terminals. When the key portion is inserted into an ignition key cylinder, the terminals are connected to a battery of a motor car. Thereby, the secondary battery is charged.

In the case of the aforementioned conventional device or transmitter, the coded signal generator is always connected to a power source, i.e. the secondary battery. Thus, the conventional device consumes the power supplied from the secondary battery considerably even when the operating button is off or released. When using the car frequently, the secondary battery is sufficiently charged through the charging terminals even if the current consumption in case where the transmitter is unused is large. Therefore, the volume or capacity of the secondary battery can be small. However, in case where the car is seldom used, the volume or capacity of the secondary battery should be large in such a manner to be able to tolerate the large current consumption at the time when the transmitter is unused, even though the portability of the device is degraded. As a countermeasure to this, the conventional transmitter is provided with a solar battery or solar cell on the outer surface of the case, which can be used to charge the secondary battery even when the car is not driven, to thereby prevent an increase in volume or capacity of the secondary battery.

The conventional device, however, does not take any measures to decrease the current consumption at the time when the transmitter is unused. If such measures are taken, the capacity of the secondary battery and the area of the solar battery can be further decreased. Moreover, the charging terminals can be unnecessary.

SUMMARY OF THE INVENTION

Accordingly, an object of the present invention is to provide a transmitter which can reduce the current consumption at the time when a coded signal generator is in a stand-by state to substantially zero, thereby decreasing the capacity of a secondary battery and the area of a solar battery.

Other features, objects and advantages of the present invention will become apparent from the following description of preferred embodiments with reference to the drawings in which like reference characters designate like or corresponding parts throughout several views.

DETAILED DESCRIPTION OF THE PREFERRED EMBODIMENTS

Figure 1:
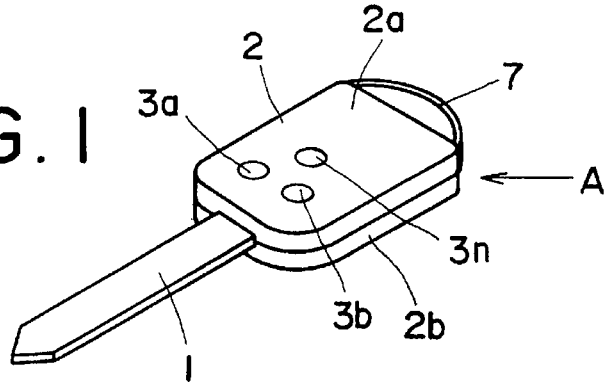
FIG. 1 is a perspective view of a transmitter according to the present invention.

Hereinafter, the preferred embodiments of the present invention will be described in detail by referring to the accompanying drawings.

FIGS. 1 to 4 illustrate a transmitter A embodying the present invention, namely, a first embodiment of the present invention. This transmitter A is produced so small that a person can carry it in his pocket. Further, the transmitter A has a T-shaped key 1 and a case 2 for covering a base portion 1*a* of the key 1, which case 2 is made of a non-conductive material such as synthetic resin. The case 2 consists of an upper case 2*a* and a lower case 2*b* which are fastened to each other with screws or adhesives (not shown) or by performing an ultrasonic welding or the like.

A plurality of operating buttons 3*a*, 3*b*, . . . 3*n* are provided on the top surface of the upper case 2*a*. On the other hand, a solar battery or solar cell 4 is provided on the bottom surface of the lower case 2*b* (see FIG. 3). One of the operating buttons is used for the switching of the state of a door lock device between a locked state and an unlocked state, which is the most important use or purpose of the transmitter A. The remaining buttons are used for the releasing of a trunk lid, the opening and closing of window glass, the starting and stopping of a vehicle engine, the turning-on and turning-off of a hazard lamp and so on. Although there is no limit to the total number of operating buttons, the desirable number of the buttons is three or so in view of the size of the case 2 and the operability of the transmitter.

A space portion of the proper size is provided within the case 2. Further, a printed circuit board 6, on which a coded signal generator 5 is contained, is mounted in the space portion. When a desired one of the operating buttons is pushed, the generator 5 outputs a specific coded signal which should be transmitted from an antenna 7 to a receiving portion of the vehicle body (not shown).

Figure 4:
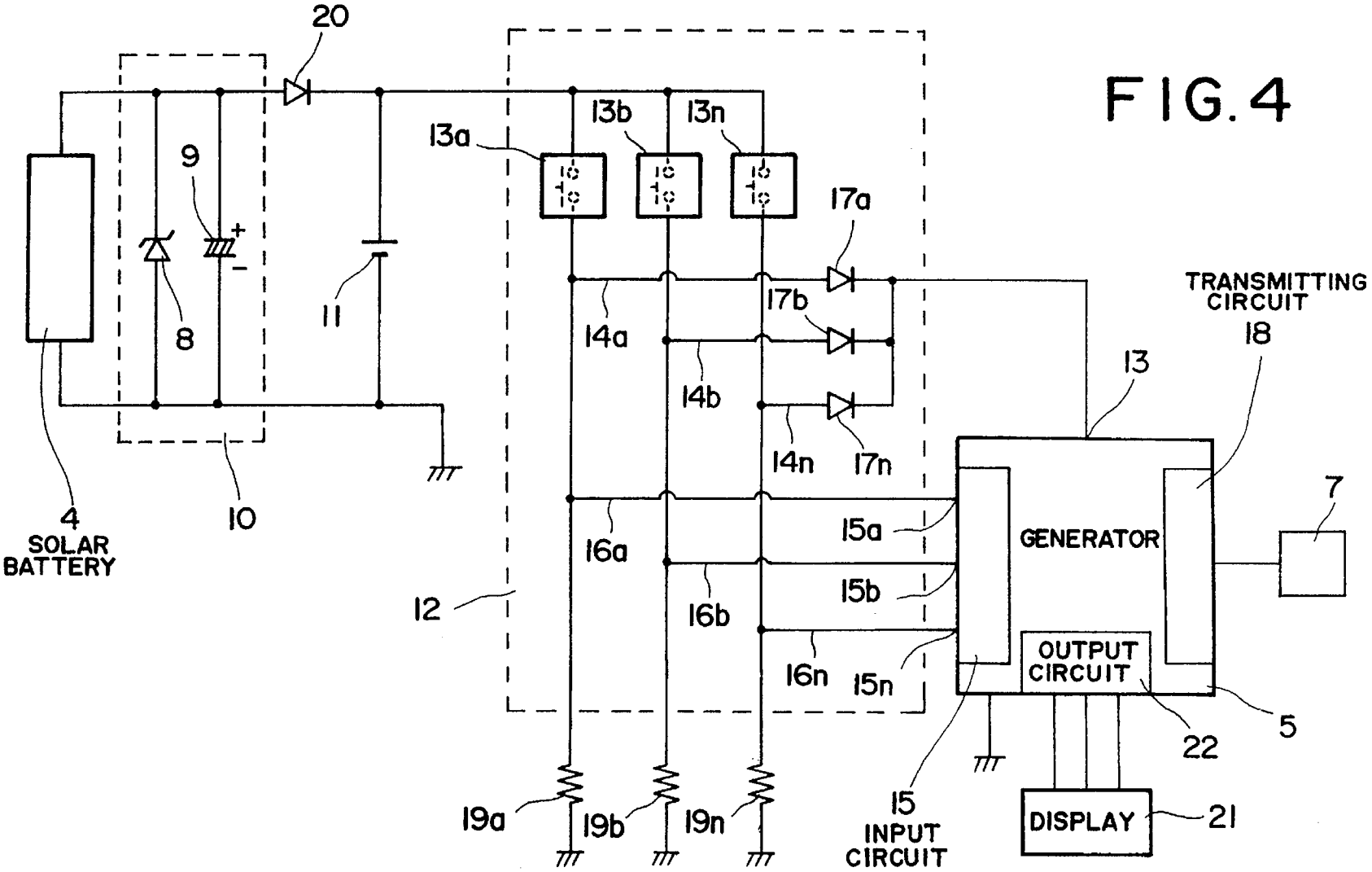
FIG. 4 is a schematic block circuit diagram for illustrating the configuration of the circuit board of a first embodiment of the present invention.

FIG. 4 is a schematic circuit diagram for illustrating the configuration of the circuit mounted on the circuit board 6. This circuit has a voltage stabilizing circuit 10 consisting of a diode 8 and a capacitor 9, a rechargeable secondary battery 11 and an operating portion 12 provided with the operating buttons 3*a*, 3*b*, . . . 3*n*, each of which is connected to the positive terminal of the secondary battery 11 at a terminal thereof. A positive terminal 13 of the coded signal generator 5 is connected to the operating buttons 3*a*, 3*b*, . . . 3*n* through lines 14*a*, 14*b*, . . . 14*n*. Further, input terminals 15*a*, 15*b*, .

. . 15*n* of an input port 15 of the coded signal generator 5 are connected to the other terminals of the operating buttons 3*a*, 3*b*, . . . 3*n* through signal lines 16*a*, 16*b*, . . . 16*n*, respectively. When one of the buttons of the operating portion 12 is pushed, the power is supplied from the secondary battery 11 to the positive terminal 13 of the coded signal generator 5 through either one of diodes 17*a*, 17*b* . . . 17*n* for preventing reverse current on the line 14*a*, 14*b*, . . . 14*n*. Simultaneously, the current representing a HIGH-level operating signal is sent to one of the input terminals 15*a*, 15*b*, . . . 15*n* of the input port 15 as through the signal line connected to the pushed operating button. Then, a transmitting circuit 18 of the generator 5 having received the power and the operating signal in this way outputs a coded signal to the antenna 7, which varies with the kind of the received operating signal.

The input terminals 15*a*, 15*b*, . . . 15*n* of the input port 15 are grounded through pull-down resistors 19*a*, 19*b*, . . . 19*n*, respectively. When all of the operating buttons 3*a*, 3*b*, . . . 3*n* are off, a LOW level signal of 0 volts is supplied to the input terminals 15*a*, 15*b*, . . . 15*n* through the pull-down resistors 19*a*, 19*b*, . . . 19*n*. Further, when one of the operating buttons 3*a*, 3*b*, . . . 3*n* is on or pushed, the pull-down resistors 19*a*, 19*b*, . . . 19*n* restrain electric currents from flowing into the ground.

Excepting a case where spontaneous discharge occurs, the power (preferably, 3 volts) supplied from the secondary battery 11 of the first embodiment is consumed only when one of the operating buttons 3*a*, 3*b*, . . . 3*n* is pushed. Namely, when all of the operating buttons are off, electric current is completely interrupted between the secondary battery 11 and the positive terminal of the generator 5.

The secondary battery 11 is connected through a diode 20 for preventing reverse current to the voltage stabilizing circuit 10 for stabilizing the voltage of the solar battery 4. The power or voltage generated by the solar battery 4 is averaged by the storage and discharge action of the capacitor 9. Then, the averaged power is stored in the secondary battery 11. When the voltage of the solar battery 4 is excessively high, surplus current flows to the diode 8, so that the voltage can be prevented from rising excessively.

Incidentally, and not as in prior-art devices, the power generated by the solar battery 4 need not be more than the demanded power of the coded signal generator 5. Generally, the operating current of the coded signal generator employed in a conventional transmitter is 20 mA or so. In case where this current is supplied only from the solar battery 4, the area surface of the portable case 2 is likely to be insufficient in comparison with the area of the solar battery 4.

The solar battery 4 of the present invention is provided in order to charge the secondary battery 11. The number of use of the transmitter per day is 20 or so at most, and the operating time of the transmitter at one time of use thereof is 0.1 second or so. Further, as described above, when being in a stand-by state, the generator 5 of the present invention does not consume the power supplied from the secondary battery 11. Therefore, in case where small loss is neglected, the solar battery 4 has only to generate the electric energy required to operate the generator 5 for about two seconds, in a long life of the battery, namely, in approximately twelve hours. Further, the capacity of the secondary battery 11 can be set as being equivalent to such electric energy. However, the power generated by the solar battery 4 changes according to the conditions of, for instance, the weather and the storage area. Thus certain margins should be allowed for the capacity of the secondary battery 11 and for the power generated by the solar battery 4.

Figure 2:
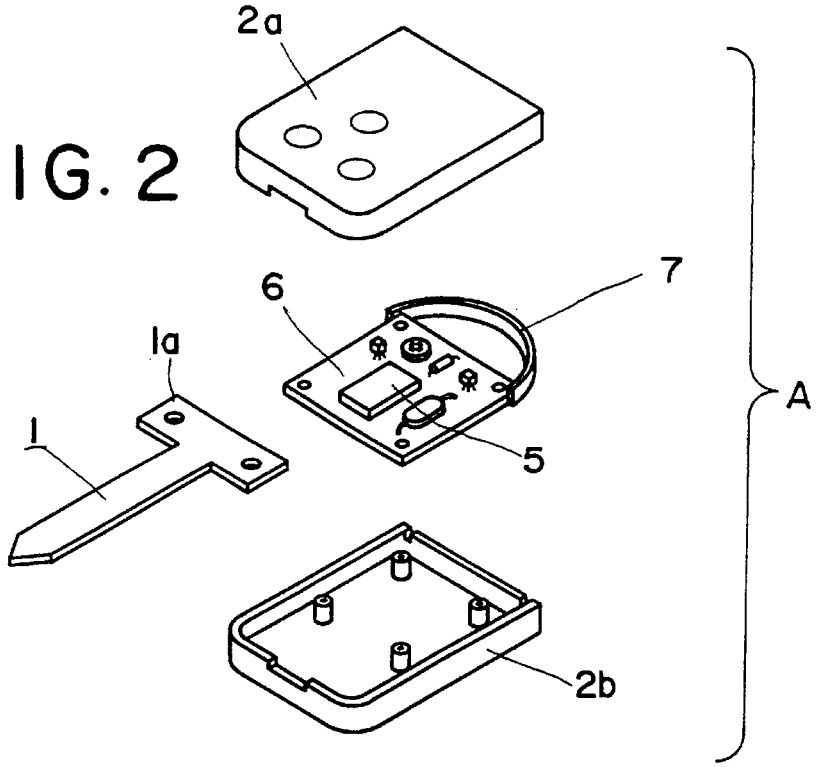
FIG. 2 is an exploded view of the transmitter according to the present invention.
Figure 3:
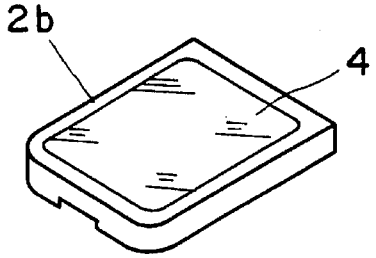
FIG. 3 is a perspective view of the bottom surface of a lower case.

As shown in FIGS. 1 and 2, the antenna 7 is fitted to the case 2 so that it can be used as a key case. When a person takes the case 2 in his hand and then pushes the operating button with a fingertip, the antenna 7 of the present invention comes in contact with his hand. Thereby, the body of the person can serve as an antenna. The available frequencies of the electric waves for a transmitter vary with countries. In the case where the frequencies ranging from about 63 MHz to about 65 MHz are available as in Japan, the desirable length of the antenna is in the range of about 1.1 m to about 2.4 m. Thus the desirable length is approximately equal to a person's height. Therefore, good outputs can be expected.

The coded signal generator 5 has an output circuit 22 for transmitting a signal to a display portion 21. Preferably, the display portion 21 consists of light emitting diodes and changes the contents of displayed information according to the kind of the pushed operating button.

Figure 5:
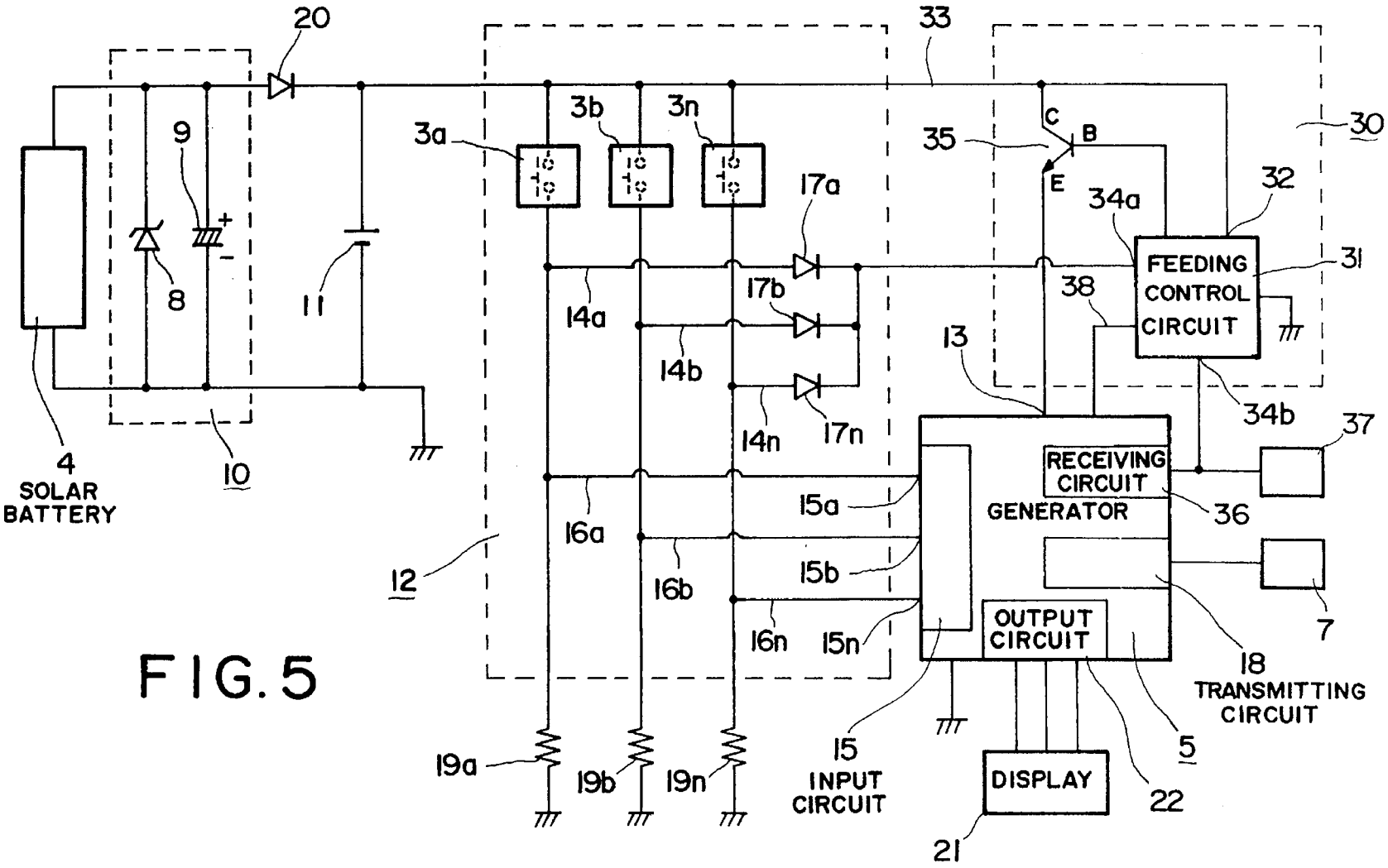
FIG. 5 is a schematic block circuit diagram for illustrating the configuration of the circuit board of a second embodiment of the present invention.

Next, a second embodiment of the present invention will be described hereinbelow by referring to FIG. 5. Incidentally, in this figure, like reference characters designate like components of the first embodiment. In the second embodiment, a transmitter has a receiving function. Namely, in the case of some kind of a door lock device, a feedback signal is sent to a transmitter upon completion of an operation according to a coded signal. The second embodiment is constructed so as to be able to receive such a feedback signal and to reduce the demanded power at the time when being in a stand-by state.

The transmitter of the second embodiment has a feeding unit 30 for feeding power to a coded signal generator 5. A positive terminal 32 of a control circuit 31 of the feeding unit 30 is connected to the secondary battery 11 through a power supply line 33. Therefore, the control circuit 31 consumes the power supplied from the secondary battery 11 even when being in a stand-by state. However, the demanded power of the control circuit 31 being in a stand-by state is extremely less than the demanded power of the generator 5 being in a stand-by state. An input port 34*a* of the control circuit 31 is connected to operating buttons 3*a*, 3*b*, . . . 3*n* through lines 14*a*, 14*b*, . . . 14*n*, respectively. When one of the buttons is pushed, electric current representing an operating signal is fed from the secondary battery 11 to the control circuit 31. The feeding unit 30 contains a transistor 35 which has a base connected to the control circuit 31, an emitter connected to a positive terminal 13 of the generator 5, and a collector connected to the power supply line 33. When receiving the operating signal in response to the operation of one of the buttons, the control circuit 31 sends out electric current to the base of the transistor 35 to thereby feed the power from the secondary battery 11 to the positive terminal 13 of the generator 5. As described above, when one of the buttons is on, the generator 5 of the second embodiment receives the power from the secondary battery 11 through the feeding unit 30. Incidentally, similarly as in the case of the first embodiment, a HIGH level signal is supplied to the input port 15 of the generator 5 through a signal line 16*a*, 16*b*, . . . or 16*n*.

A receiving antenna 37 is connected to an input port 34*b* of the control circuit 31 and a receiving circuit 36 of the generator 5. The antenna 37 may be also used as a transmitting antenna 7. When detecting the feedback signal received by the antenna 37, the circuit 31 sends out electric current to the base of the transistor 35 to thereby feed the power from the secondary battery 11 to the generator 5.

The receiving circuit 36 of the generator 5 analyzes the received feedback signal and sends out a signal representing a result of the analysis to the output circuit 22. The result of the analysis is displayed in the display portion 21.

Upon completion of the processing of the feedback signal, the generator 5 outputs a termination signal to the control circuit 31 through a line 38 with an appropriate delay so as to stop the control circuit 31 from supplying the power.

As described above, in the case of the second embodiment, the power is always supplied from the secondary battery 11 to the control circuit 31. However, the demanded power of the control circuit 31 being in a stand-by state is significantly less than the demanded power of the generator 5 being in a stand-by state. Note that when being in a stand-by state or an unused state, no power is supplied to the coded signal generator 5.

Incidentally, the aforementioned value of the operating current of the generator 5 is just an example for reference purpose.

Although the preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A remote control transmitter used for a switching of a state of a door lock device between a locked state and an unlocked state and so on comprising:

a portable-size case;

at least one operating button provided on an outer surface of the case;

a rechargeable secondary battery provided within the case;

a solar battery provided on the outer surface of the case and rechargeably connected to the secondary battery; and a generator for generating a coded signal, wherein when the operating button is pushed, electric current is fed from the secondary battery to the generator; and wherein one of terminals of the operating button is connected to a positive terminal of the secondary battery and the other of the terminals of the operating button is connected to a positive terminal of the generator.

2. A remote control transmitter according to claim 1, which has a plurality of operating buttons, wherein the generator has a plurality of input terminals connected to the plurality of operating buttons, respectively.

3. A remote control transmitter according to claim 2, wherein a positive terminal of the generator is connected to each of the plurality of operating buttons through a diode.

4. A remote control transmitter according to claim 1, which further comprises a key having a base portion mounted in the case.

5. The remote control transmitter according to claim 1, wherein the operating button comprises a two-terminal, momentary-contact switch such that depressing the button causes the one of the terminals to be electrically connected to the other of the terminals.

6. A remote control transmitter used for a switching of a state of a door lock device between a locked state and an unlocked state and so on comprising:

a portable-size case;

at least one operating button provided on an outer surface of the case;

a rechargeable secondary battery provided in the case;

a solar battery provided on the outer surface of the case and rechargeably connected to the secondary battery; and a generator for generating a coded signal when the operating button is pushed;

a feeding unit provided between the generator and the secondary battery, said feeding unit having a first input port for receiving electric current as an operating signal when the push button is pushed, a second input port for receiving a feedback signal as an operating signal and means for feeding power from the secondary battery to the generator, wherein the unit feeds the power from the secondary battery to the generator when the unit receives one of the operating signals;

a detecting means of said generator for detecting the feedback signal; and a display portion adapted to operate in response to an output of the generator; and wherein a power output of the solar battery is substantially less than an instantaneous transmitting power of the generator.

7. A remote control transmitter according to claim 6, wherein the feeding unit connects the secondary battery with the generator through a transistor.

8. A remote control transmitter according to claim 6, which has a plurality of operating buttons, wherein the generator has a plurality of input terminals connected to the secondary battery through the operating buttons, respectively.

9. A remote control transmitter according to claim 6, wherein the first input port is connected to each of the plurality of operating buttons though a diode.

10. A remote control transmitter according to claim 6, which further comprises a key having a base portion mounted in the case.

11. A remote control transmitter used for a switching of a state of a door lock device between a locked state and an unlocked state and so on comprising:

a portable-size case;

at least one operating button provided on an outer surface of the case;

a rechargeable secondary battery provided within the case;

a solar battery provided on the outer surface of the case and rechargeably connected to the secondary battery; and a generator for generating a coded signal; wherein when the operating button is pushed, electric current is fed from the secondary battery to the generator, and wherein a power output of the solar battery is substantially less than an instantaneous transmitting power of the generator.

12. The remote control transmitter according to claim 11, wherein a positive terminal of the generator is supplied with battery power through a switch.

13. An automobile key having a handle portion, the handle portion comprising:

a photo-electric cell disposed on an outside of the handle portion, the cell having a power output when exposed to ambient light;

a rechargeable electric storage battery coupled to the cell to receive electricity therefrom;

a momentary-contact switch closed by a push-button, the push-button disposed on the outside of the handle portion;

a radio transmitter having a time-average power requirement over intermittent use, the time-average power requirement being substantially less than a peak transmission power requirement of the transmitter and less than or equal to the power output of the cell;

the momentary-contact switch being coupled between a terminal of the storage battery and the transmitter;

the transmitter including means for transmitting a coded signal to an automobile actuator.

14. The key according to claim 13, comprising a metallic antenna contact area of the handle portion, the area being coupled to a radio-frequency output of the transmitter, whereby a person holding the key and in contact with the area may act as an antenna.

15. The key according to claim 13, comprising a display lamp disposed on the outside of the handle and indicative of transmitter activity.

* * * * *